United States Patent [19]

May

[11] 3,950,274

[45] Apr. 13, 1976

[54] PROCESS FOR MAKING A LOW VOLTAGE VARISTOR

[75] Inventor: John E. May, Skaneateles, N.Y.

[73] Assignee: General Electric Company, Syracuse, N.Y.

[22] Filed: Sept. 27, 1973

[21] Appl. No.: 401,131

[52] U.S. Cl. ..... 252/519; 252/518; 252/520

[51] Int. Cl.[2] ..... H01B 1/08

[58] Field of Search ..... 252/519, 520, 518

[56] References Cited

UNITED STATES PATENTS 3,663,458 5/1972 Masuyama et al. ..... 252/520 X

*Primary Examiner*—Leland A. Sebastian
*Assistant Examiner*—E. Suzanne Parr
*Attorney, Agent, or Firm*—Robert J. Mooney; Douglas E. Stoner

[57] ABSTRACT

Disclosed is an improved metal oxide varistor particularly suitable for varistor operation at low voltages such as 80 volts and less, and a method for the manufacture thereof. The varistor comprises a body portion compounded of a primary component and a plurality of additives. The additives are, before combination with the primary component, mixed thoroughly and reacted to form a crystalline reaction product. After grinding, the reaction product is mixed with the primary component and the body is further processed in the conventional manner.

6 Claims, 1 Drawing Figure

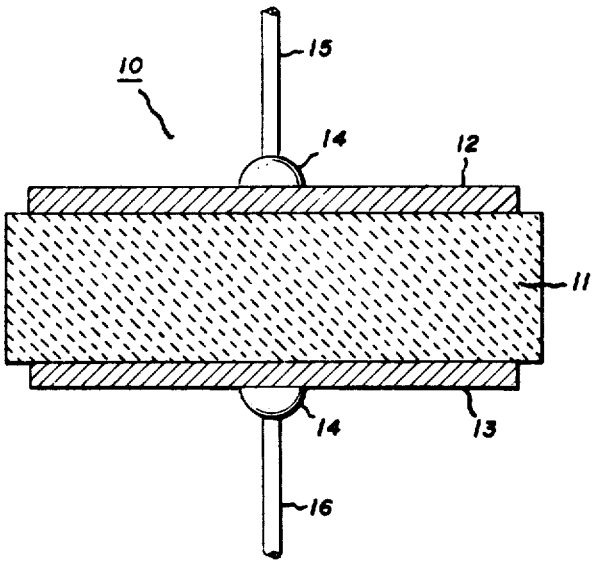
10
15
14
12
11
14
13
16

PROCESS FOR MAKING A LOW VOLTAGE VARISTOR

BACKGROUND OF THE INVENTION

This invention relates to metal oxide varistors and, more particularly, to a method of achieving a more homogeneous mixture of the several components prior to pellet pressing and thus to provide improved devices.

In general, the current flowing between two spaced points is generally directly proportional to the potential difference between those points. For most known substances, current conduction therethrough is equal to the applied potential difference divided by a constant, which has been defined by Ohm's law to be its resistance. There are, however, a few substances which exhibit non-linear resistance. Some devices, such as metal oxide varistors, utilize these substances and require resort to the following equation (1) to quantitatively relate current and voltage:

$$I = (V/C)^{\alpha} \qquad (1)$$

where V is the voltage applied to the device, I is the current flowing through the device, C is a constant and $\alpha$ is an exponent greater than 1. Inasmuch as the value of $\alpha$ determines the degree of non-linearity exhibited by the device, it is generally desired that $\alpha$ be relatively high. $\alpha$ is calculated according to the following equation (2):

$$(2) \qquad \alpha = \frac{\log_{10}(I_2/I_1)}{\log_{10}(V_2/V_1)}$$

where $V_1$ and $V_2$ are the device voltages at given currents $I_1$ and $I_2$, respectively.

At very low voltages and very high voltages metal oxide varistors deviate from the characteristics expressed by equation (1) and approach linear resistance characteristics. However, for a very broad useful voltage range the response of metal oxide varistors is as expressed by equation (1).

The values of C and $\alpha$ can be varied over wide ranges by changing the varistor formulation and the manufacturing process. Another useful varistor characteristic is the varistor voltage which can be defined as the voltage across the device when a given current is flowing through it. It is common to measure varistor voltage at a current of one milliampere and subsequent reference to varistor voltage shall be for voltage so measured. The foregoing is, of course, well known in the prior art.

Metal oxide varistors are usually manufactured as follows. A plurality of additives is mixed with a powdered metal oxide, commonly zinc oxide. Typically, four to twelve additives are employed, yet together they comprise only a small portion of the end product, for example less than five to ten mole percent. In some instances the additives comprise less than one mole percent. The types and amounts of additives employed vary with the properties sought in the varistor. Copious literature describes metal oxide varistors utilizing various additive combinations. For example, see U.S. Pat. No. 3,663,458. A portion of the metal oxide and additive mixture is then pressed into a body of a desired shape and size. The body is then sintered for an appropriate time at a suitable temperature as is well known in the prior art. Sintering causes the necessary reactions among the additives and the metal oxide and fuses the mixture into a coherent pellet. Leads are then attached and the device is encapsulated by conventional methods.

A problem encountered in the manufacture of metal oxide varistors by the prior art method is the inability to precisely predict and control the properties of the device. Thus manufacturing yield is a matter of concern to varistor manufacturers. This inability to control the properties of the device becomes more severe as the manufacturing process is changed to one which should theoretically yield lower voltage devices and has heretofore frustrated efforts to develop a commercially suitable low voltage (e.g. 80 volts) device.

While the conduction process in metal oxide varistors is not fully understood, it is believed that an important part of the problem is the inability to thoroughly and uniformly mix the several components prior to pellet processing. The reasons for this belief are as follows. It must first be realized that chemical changes occur during sintering. When several additives are used to tailor the resulting properties of the device, it appears desirable that they interact in addition to each reacting with the zinc oxide. However, often each additive comprises only a fraction of a mole percent of the total compound mixture and the metal oxide comprises 90 or more mole percent. Thus, inasmuch as the components are in a particulate form, the final mixture just prior to pellet pressing is a dispersion of isolated particles of each additive in a sea of metal oxide particles. Consequently, many of the additive particles are surrounded by an abundance of metal oxide particles but may be remote from particles of the other additives and thus be unable to react therewith. An additive particle reacting only with the metal oxide may, of course, create a different material than an additive particle reacting with other additives and the metal oxide. This situation is more likely to occur if the mixing of the metal oxide and the additives is inadequate. Thus, the inability to adequately control the mixing of the components makes final varistor performance difficult to control and has frustrated the development of low voltage devices.

One method of partially alleviating the problem is to increase the additive concentration. However, this is often an unacceptable solution because of the high cost of certain additives and the effects on the varistor properties that an increase in additive concentration can have.

It is an object of this invention, therefore, to provide a homogeneous mixture for varistor fabrication and to insure proper interreaction of the additives.

Another object of this invention is to provide a metal oxide varistor of the foregoing character having good low voltage characteristics.

SUMMARY OF THE INVENTION

This invention is characterized by a metal oxide varistor and a method for the fabrication thereof. Additives necessary to secure the desired properties in the assembled varistor are selected and thoroughly mixed. The mixture of additives is then reacted to form a crystalline solid reaction product. For example, the mixture of additives can be heated and then cooled at a preselected rate to form the reaction product. The crystalline reaction product is then ground so that it can be thoroughly mixed with the metal oxide, for example zinc oxide, that is to form the primary component of the varistor. Following this mixing step, the varistor bodies can be further processed in a conventional manner. It will be appreciated that this method insures proper interreaction among the several additives inasmuch as this interreaction takes place when forming the reaction product which is prior to combination with the metal oxide which would cause a "dilution" of the additive mixture. Therefore, the reaction product results from thorough interaction among all the additives and what remains in the chemical process of varistor manufacture is achieved when the particles of the reaction product are mixed with the metal oxide and sintered. Furthermore, homogeneity of the final mixture is promoted inasmuch as it contains only two components rather than five or more. Thus there has been provided a method of manufacturing varistors that insures that a homogeneous mixture is provided for pellet processing and that the additives thoroughly interreact. Therefore, the ultimate behavior of the varistors is more predictable and easier to control. In addition, as will be seen below, low voltage devices can be readily fabricated by the subject method. While this method is most beneficial in the manufacture of varistors containing a very large proportion of metal oxide, it is felt that benefit is derived by its employment in the manufacture of any varistors inasmuch as the predominance of the metal oxide hinders the uniform dispersion of and proper interaction of the additives.

DESCRIPTION OF THE PREFERRED METHOD AND EMBODIMENT

These and other features and objects of the present invention will become more apparent upon a perusal of the following description taken in conjunction with the accompanying FIGURE which shows a sectional view of a metal oxide varistor.

Before proceeding with a detailed description of the method of manufacturing varistors contemplated by this invention, varistor construction will be generally described with reference to the FIGURE. A varistor 10 includes as its active element a sintered body 11 having a pair of electrodes 12 and 13 in ohmic contact with the opposite surfaces thereof. The body 11 is prepared as hereinafter set forth and can be in any form such as circular, square, or rectangular. Wire leads 15 and 16 are conductively attached to the electrodes 12 and 13, respectively, by a connection material 14 such as solder.

In manufacturing the varistor 10 additives that are to be mixed with a primary component are selected first. It has been found that a varistor with very desirable properties can be compounded from 0.5 mole percent bismuth oxide, 0.5 mole percent manganese oxide, 0.5 mole percent cobalt oxide, 0.5 mole percent titanium oxide and 98 mole percent zinc oxide. To manufacture a varistor by that formula, and in accordance with the subject method, equal molar amounts of bismuth oxide, manganese oxide, cobalt oxide, and titanium oxide are thoroughly mixed. The four additives are then reacted. One advantageous way of reacting the four aforementioned additives has been found to be heating the additive mixture to a temperature of above approximately 1000°C and then cooling the mixture at a preselected rate. At the elevated temperature a liquid reaction product is formed which crystallizes during the cooling step.

The crystalline reaction product, which results from the interaction of all the additives, is ground to a size that can effectively be mixed with zinc oxide particles. For example a good mixture can be formed when the reaction product is ground to pass through a 60 mesh screen (250 micron particle size). Next, a sufficient amount of the ground reaction product is mixed with particulate zinc oxide to provide the desired varistor composition. For example, the aforementioned formula is formed by mixing 7.12 grams of the ground reaction product with 148 grams of zinc oxide powder. Mixing the ground reaction product and the zinc oxide powder provides a final mixture that is primarily zinc oxide but contains evenly dispersed therethrough particles wherein each particle is created by the interaction of all the additives. Consequently, as the reaction product reacts with the zinc oxide during sintering each reaction is the equivalent of a reaction of all of the additives together and zinc oxide.

Thus it will be appreciated that the disclosed method provides metal oxide varistors that are fabricated from a homogeneous final mix and the method insures that the additives interreact in addition to reacting with the metal oxide. Consequently, manufacturing repeatability is enhanced and final varistor performance becomes easier to predict.

To illustrate the scope of the invention, some exemplary additive reaction processes are described below. These processes were carried out using the aforementioned varistor formula.

EXAMPLE I

When the additive mixture was heated to about 1275°C in a platinum crucible and the resulting liquid was poured into water, a crystalline solid reaction product was formed. After the product was ground and mixed with zinc oxide and sintered in a conventional manner, the following results were obtained: When the sintering took place at 1250°C, the volts per mil of thickness rating (at a current of one milliampere) of the resulting devices varied from 0.6 to 0.7 and $\alpha$ was 30. When sintering was at 1300° to 1320°C $\alpha$ ranged from 20 to 30 and the volts per mil rating dropped to 0.43.

EXAMPLE II

When the additive mixture was heated to 1275°C in a platinum crucible and air cooled, large crystals several millimeters in size were formed. After grinding and mixing with the zinc oxide and sintering at temperatures ranging from 1290° to 1320°C, the volts per mil rating varied from 0.25 to 0.45 and $\alpha$ varied from 25 to 40.

EXAMPLE III

When the additive mixture was prereacted at a temperature of 1011°C and the pellets were sintered at 1300°C, the volts per mil rating varied from 0.4 to 0.5 and $\alpha$ was 35.

Thus, it will be appreciated that a wide range of process variations is possible when practicing the subject method and a wide range of device characteristics can be obtained. Furthermore, it will be understood that varying the type, number and/or amount of additives will yield still further variations in the final product and may facilitate or require other process variations. Another very important point to be observed in the above examples is that for wafers ranging in thickness from 1 to 2 millimeters, as is common in practice, the varistor voltages range from 10 to 56 volts. Thus it is seen that low voltage devices can be manufactured by the subject method.

Many modifications and variations of the subject invention will be obvious to those skilled in the art. Consequently, the true scope of the invention is only as limited by the following claims.

What is claimed is:

1. A method for making a varistor body comprising the steps of:

mixing together and reacting a plurality of additives, said reacted additives forming a reaction product by heating them to a temperature above their melting points and then cooling them;

grinding said reaction product;

mixing ground reaction product with zinc oxide to form a final mixture; and forming said body of said final mixture by pressing and sintering.

2. A method according to claim 1 further comprising, following said step of heating said additives, a step of cooling said additives at a preselected rate.

3. A method according to claim 2 wherein said steps of heating and cooling said additives comprise fusing said additives into a fused solid.

4. A method according to claim 3 wherein said fused solid is crystalline.

5. A method according to claim 3 wherein said step of heating said additives comprises heating said additives to a temperature of above approximately 1000° Centigrade.

6. A method according to claim 1 wherein said additives comprise oxides of cobalt, manganese, bismuth and titanium.

* * * * *